United States Patent [19]

Kaiser

[11] 4,395,191

[45] Jul. 26, 1983

[54] EXCAVATOR-HOIST CONSTRUCTION VEHICLE

[76] Inventor: Josef Kaiser, Heuwies 65, FL-9491 Schaanwald, Liechtenstein

[21] Appl. No.: 215,403

[22] Filed: Dec. 11, 1980

[30] Foreign Application Priority Data

Dec. 24, 1979 [AT] Austria ..... 8138/79

[51] Int. Cl.[3] ..... B66F 9/00

[52] U.S. Cl. ..... 414/694; 180/7 R; 180/41; 280/764.1

[58] Field of Search ..... 414/694, 687; 212/189; 280/704, 764; 180/9.48, 41, 152, 153, 7 R

[56] References Cited

U.S. PATENT DOCUMENTS 3,249,174 5/1966 Orwig ..... 180/153

3,899,037 8/1975 Yaker ..... 180/41 X

FOREIGN PATENT DOCUMENTS 2127434 1/1972 Fed. Rep. of Germany ..... 414/687

*Primary Examiner*—Robert J. Spar

*Assistant Examiner*—Donald W. Underwood

*Attorney, Agent, or Firm*—Toren, McGeady and Stanger

[57] ABSTRACT

An excavator-hoist construction vehicle includes an undercarriage with a superstructure supported on it for rotation about a vertical axis. A boom is hinged to the superstructure and supports a tool for digging, lifting or the like. Two pair of supporting legs are attached to the undercarriage, one pair extending forwardly and the other rearwardly. The supporting legs are adjustably movable in the vertical and horizontal directions. Each of the ends of the supporting legs spaced outwardly from the undercarriage are arranged to support a wheel. The wheels on one pair of the supporting legs can be steered and at least one wheel on the supporting legs can be driven.

13 Claims, 10 Drawing Figures

EXCAVATOR-HOIST CONSTRUCTION VEHICLE

SUMMARY OF THE INVENTION

The present invention is directed to an excavator-hoist construction vehicle having a superstructure mounted on an undercarriage so that it is rotatable about a vertical axis. A boom arranged to support a tool, such as a digging bucket, a lifting or gripping device or the like, is hinged to the superstructure and extends outwardly from it. Supporting legs are pivotally connected to the front and rear edges of the undercarriage. The supporting legs are adjustably movable in vertical and horizontal planes and supporting members are secured to the ends of the supporting legs spaced outwardly from the undercarriage.

Two types of such excavator-hoist construction vehicles are known. One type is a mobile vehicle. The undercarriage of this mobile vehicle is supported on driven wheels on which the vehicle travels. Such mobile vehicles, however, can only be used over flat terrain and, further, the use of the vehicle is limited because its track width can be varied only insignificantly if at all.

The second type of such a construction vehicle is a stepping excavator-hoist. Such vehicles have cantilivered supporting legs at the front and rear of an undercarriage and the supporting legs can be adjusted independently of one another in the horizontal and vertical directions so that the track width and elevation of the wheel positions can be varied. As a result, such stepping vehicles can be used on uneven, steep and impassable terrain. In such stepping vehicles, the supporting legs, extending from one side of the undercarriage, have non-driven wheels and the other supporting legs mount holding claws for supporting the vehicles on the ground. Movement of such stepping vehicles is effected by lifting the supporting legs mounting the holding claws and pressing the boom against the ground. Due to the bending action attainable in the multi-part boom used on such a vehicle, it is pushed or pulled on the non-driven wheels. Such stepping vehicles cannot be used for the transportation of loads, because the boom is needed for the movement of the vehicle. During movement, any load would have to be placed on the ground and moved subsequently after the vehicle is moved, since the boom is free for lifting and moving a load only when it is not involved in the movement of the vehicle.

In German Auslegeschrift No. 22 11 148 a floating dredger is disclosed. The body of this floating vehicle supports a boom. Two supporting legs are hinged at one end face of the floating body and are adjustable in the horizontal and vertical directions. The free ends of the supporting legs mount wheels which can be moved from a vertical position to a horizontal position. Another supporting leg is attached to the opposite end face of the floating body and can also be moved vertically and horizontally. A pair of wheels can be attached to this other supporting leg. On land, the floating dredger is moved on the wheels and during forward movement the two supporting legs extending from one end face are interconnected by a connecting rail. During its use as a floating dredger, the wheels on the pair of supporting legs are folded into the horizontal position so that the dredger can be supported on the bottom of a body of water. The other supporting leg carries a sword-type attachment so that the dredger can be anchored to the bottom of the body of water.

Therefore, the primary object of the present invention is to provide a so-called stepping construction vehicle which affords improved operation and mobility of such a vehicle. In accordance with the invention, wheels can be provided as supporting members at the outer ends of the four supporting legs on the vehicle with at least one pair of the wheels being steerable and with at least one of the wheels being driven. With such an arrangement, it is possible for a stepping construction vehicle to be used on steep and impassable terrain for the transportation of loads, and, further, its mobility is considerably improved on impassable terrain.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
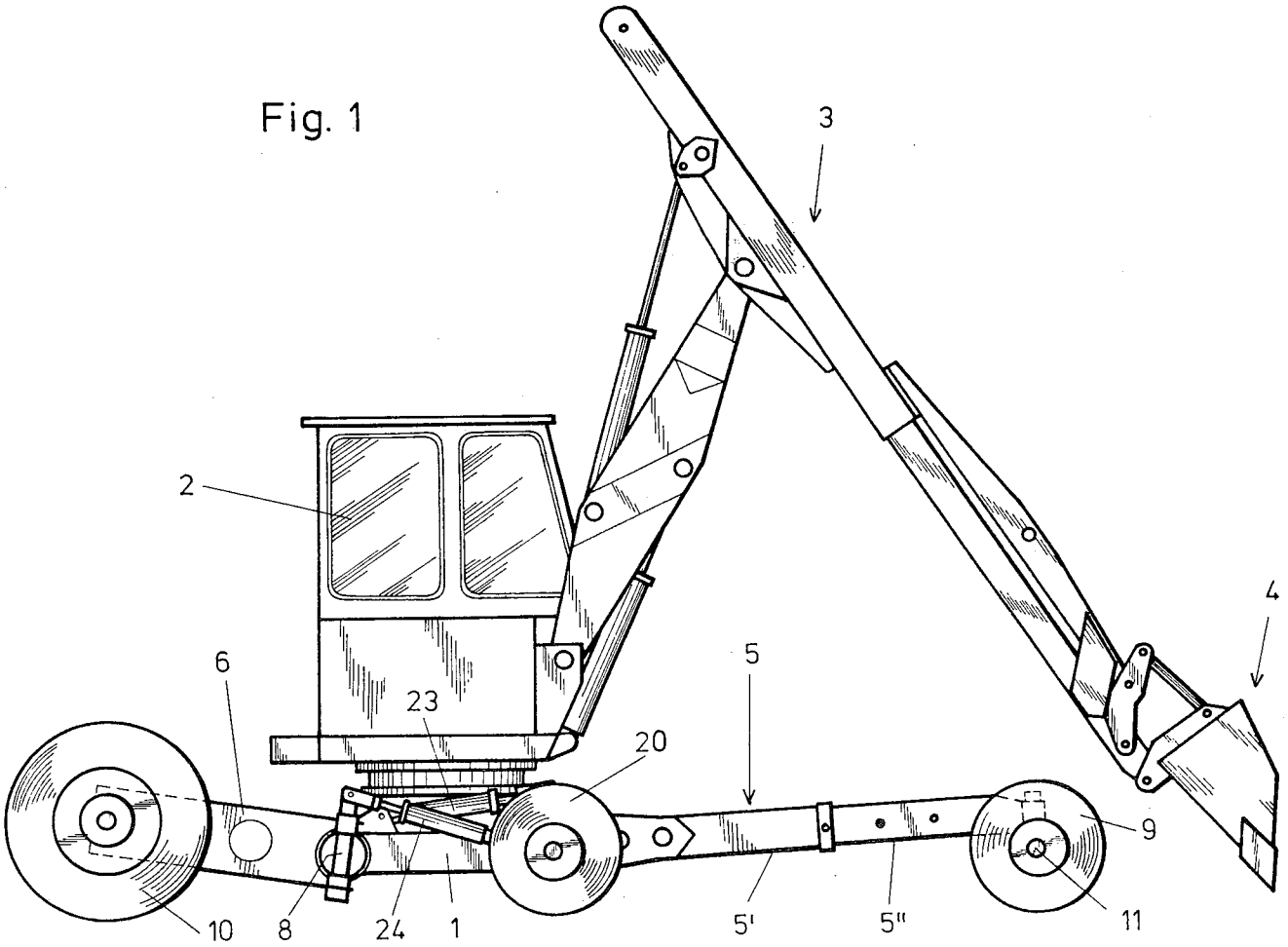
FIG. 1 is a side elevational view of a stepping excavator-hoist construction vehicle.
Figure 2:
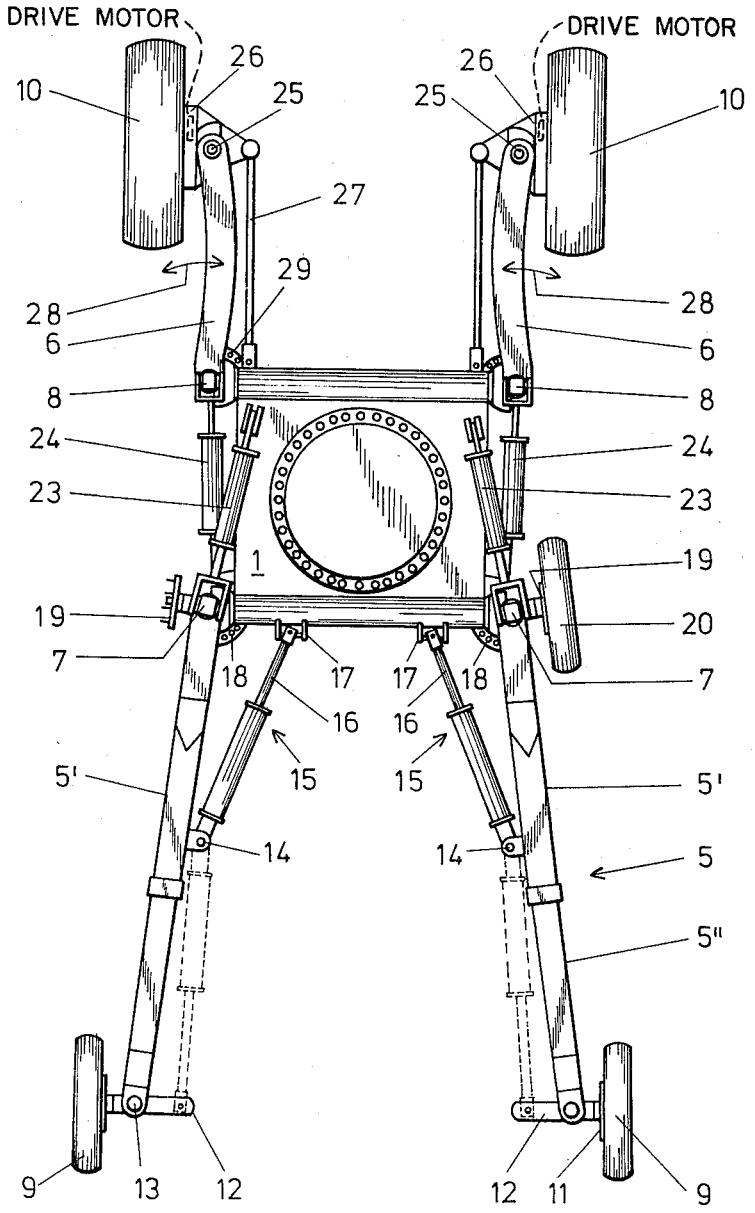
FIG. 2 is a plan view of the vehicle shown in FIG. 1, however, the superstructure has been omitted for reasons of clarity.

In a first embodiment of the stepping excavator-hoist construction vehicle illustrated in FIGS. 1 and 2, the vehicle includes an undercarriage 1 on which a superstructure 2 is rotatable about a vertical axis. The superstructure 2 includes the operator cab with the driving instruments. A multi-part boom 3 is articulated to the superstructure and is shown with a digging bucket 4 secured to the free end of the boom spaced outwardly from the superstructure. For the sake of description, as viewed in FIG. 1, the right-hand side of the superstructure 2 from which the boom 3 extends is considered to be the front of the vehicle and the opposite side, that is, the left-hand side of the superstructure is the rear side. A pair of supporting legs 5 are hinged to the front edge of the undercarriage and another pair of supporting legs 6 are hinged to the rear edge of the undercarriage. Each of the supporting legs 5 consists of two tubular sections 5', 5'' with one being telescopically movable inside the other. The supporting legs 5 and 6 are adjustable independently of one another in both the horizontal and vertical directions in a known manner. For the supporting legs 5, horizontal adjustability is provided about a bearing bolt 7 arranged in the upright position and a similar upright bearing bolt 8 provides the horizontal adjustability of the other supporting legs. Accordingly, the supporting legs 6 are not only adjustable to the type of terrain over which the vehicle travels, however, it is also possible to change the track width of the wheels and the relative elevational level of the wheels, note FIGS. 5 and 6. Wheels 9 are positioned at the outer ends of the supporting legs 5 and wheels 10 are positioned at the outer ends of the supporting legs 6. For adjusting the position of the supporting legs 5 and 6 in the vertical direction about horizontal axes, piston-cylinder assemblies 23, 24 are located along each of the side edges of the undercarriage with the assemblies being fixed at one end to the undercarriage and at the other end to the supporting legs. The assemblies 23 are attached to the supporting legs 5 and the assemblies 24 are attached to the supporting legs 6. Supporting legs 6 have a predetermined fixed length. At the ends of these legs 6 spaced outwardly from the undercarriage 1, wheel hubs 26 are provided which can be pivoted about upright axle 25. Conventional driving motors for driving the wheels 10 are arranged in the wheel hubs. With the hubs 26 being pivotally mounted, parallel steering suspensions 27 are connected to each of the wheels 26 and are hinged to the undercarriage 1. The parallel steering suspension 27 guarantees that the two wheels 10 maintain their parallel position with respect to one another during horizontal pivotal movement of the supporting legs 6 in the direction of the arrow 28, note FIG. 2. These supporting legs 6 are manually pivoted with their position relative to the undercarriage 1 being fixed by a hole-bolt connection 29. The structure of such a hole-bolt connection is well known and extensively used, accordingly, further detailed explanation is not required.

Figure 3:
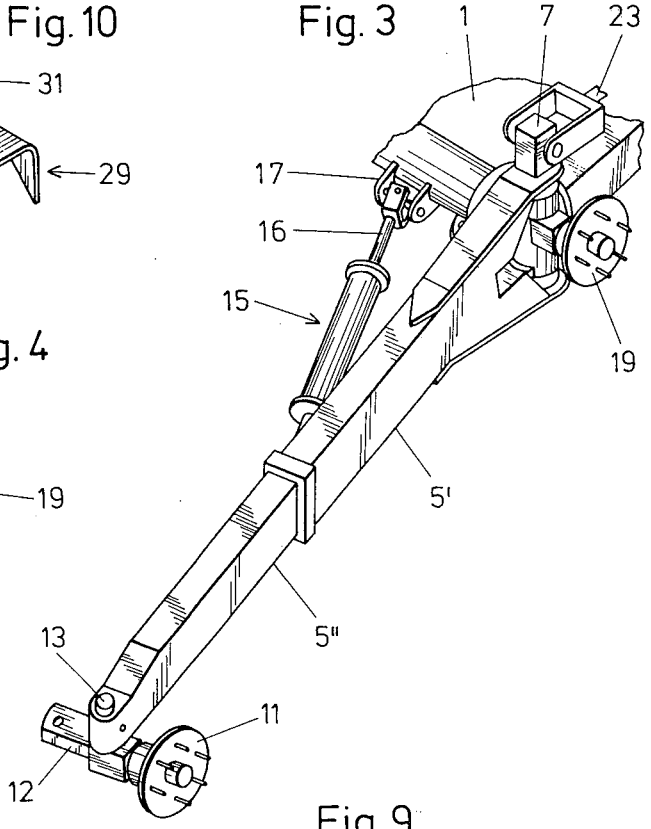
FIG. 3 is a perspective view of one of the supporting legs of the vehicle as shown in FIG. 1.

Steerable wheel 9 are detachably hinged to the outer or free ends of the supporting legs 5. Each wheel 9 is mounted on a wheel hub 11 which is attached to a wheel support 12. Wheel support 12 includes an upright shaft 13, note FIGS. 2 and 3, which is insertable from the bottom into a corresponding bore or sleeve in the free end of the supporting leg 5. Shaft 13 is somewhat longer than the receiving bore into which it fits so that the inserted shaft protrudes upwardly out of the sleeve, note FIG. 3. The protruding portion of shaft 13 is secured against axial shifting by a member, not shown. At the end of tubular section 5' of each supporting leg 5, note FIG. 3, a flange 14 is welded and one end of a piston-cylinder assembly 15 is hinged to the flange. As illustrated in full lines in FIG. 2, the opposite end of the piston rod 16 of the piston-cylinder assembly 15 is attached to a flange 17 mounted on the front side of the undercarriage 1. This connection at the flange 17 is easily detachable and the piston-cylinder assembly can be swivelled from the position shown in full lines to the position shown in dashed lines with the end of the piston rod projecting from the piston-cylinder assembly being connected to the wheel support 12. The arrangement of the piston-cylinder assembly shown in dashed lines serves for steering the wheels 9. The control of the piston-cylinder assemblies 15 is such that both of the assemblies are acted upon in the same manner, reciprocally and simultaneously, so that the wheels can travel through the same turning circle. When the piston-cylinder assemblies 15 are in position for steering the wheels 9, the position indicated by the dashed lines in FIG. 2, then the pivoted position of the supporting legs 5 is secured by a bolt-hole connection 18.

Figure 4:
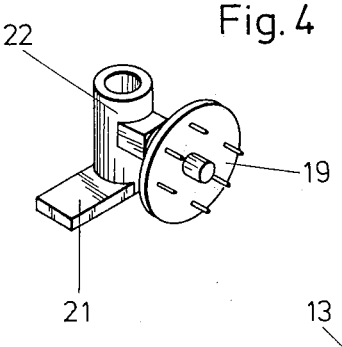
FIG. 4 is a perspective view of a hub for an additional travelling wheel.

Adjacent the position of the bearing bolts 7 on the supporting legs 5 are additional hubs 19, each arranged to receive an additional wheel 20. In FIG. 2 a wheel 20 is shown on one side of the undercarriage 1, however, the wheel hub 19 on the opposite side is shown without a wheel 20. These wheels 19 each have a tube socket 22 through which the bearing bolt 7 extends and, in addition, a laterally cantilivered flange 21, note FIG. 4, extends from the tube socket so that the hub 19 is connected to the associated supporting leg in such a way that it can participate in its horizontal pivotal movements.

Basically, it is possible to arrange the wheels 10 so that they can be selectively steered permitting a reduction in the turning radius of the vehicle.

Figure 10:
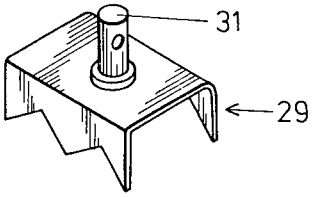
FIG. 10 is a perspective view of a holding claw.

The steerable wheels are mounted on the supporting legs so that they can be easily detached and, when removed, a holding claw 29, see FIG. 10, can be inserted in place of the wheel. The appropriate supporting member selected, either wheel 9 or holding claw 29, depends on the type of work to be performed by the construction vehicle.

Figure 5:
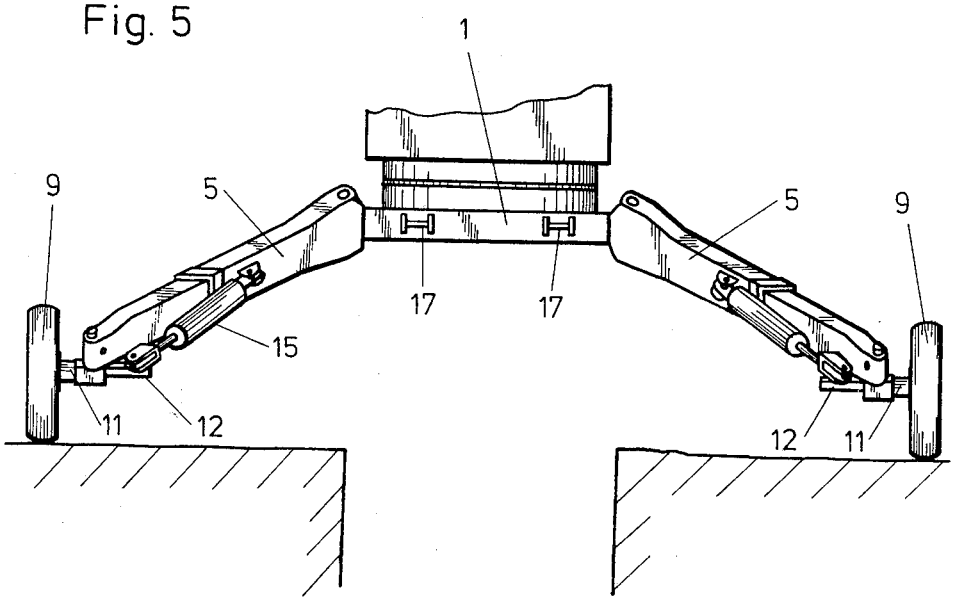
FIGS. 5 and 6 illustrate two partial views of the vehicle illustrating, for reasons of clarity, only the steerable wheels and displaying two ways in which the steerable wheels can be positioned relative to one another.

In FIG. 5 a stepping construction vehicle is shown capable of being used in a manner not possible with known mobile or stepping construction vehicles. Such use is particularly directed to the excavation of ditches or the like. Compared to the width of the ditch over which the vehicle is positioned, its track width is much greater than the width of the ditch, note FIG. 5, whereby the weight of the vehicle is distributed on the area of the adjacent ground which is removed from the edge of the ditch so that the danger of the collapse of the ditch edge is reduced. The stepping construction vehicle can be moved to any point along the length of the ditch and it is possible to lift out form work at one point, move it along the ditch and then place it in a new location in the ditch. It is not possible to work in such a ditch with a commercial mobile construction vehicle of similar capability unless alongside the ditch there is sufficient space for the vehicle, however, the operator in such an arrangement is not able to view the length of the ditch and it makes the work involved more difficult.

Figure 6:
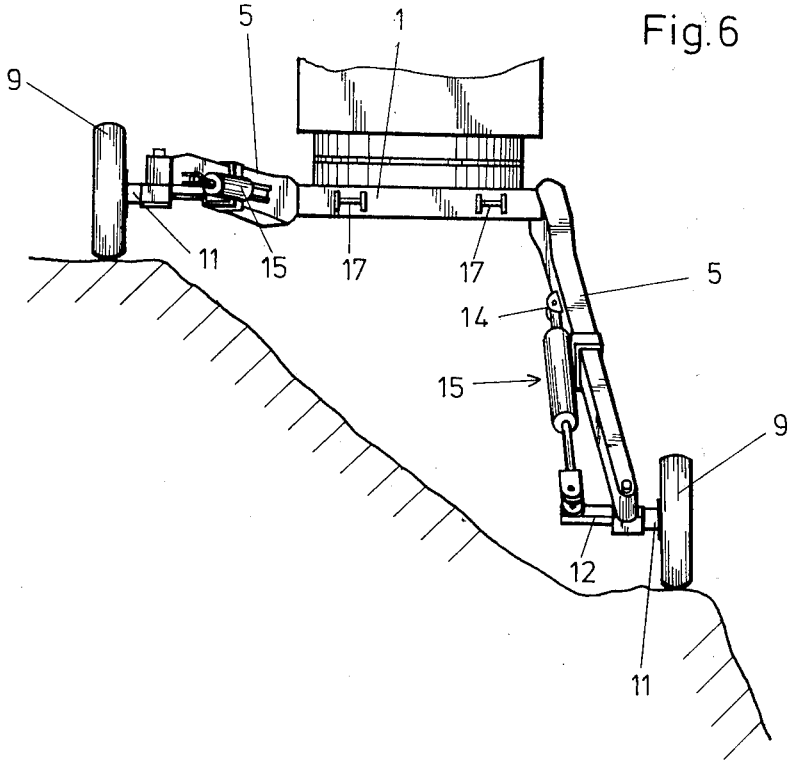

In the arrangement shown in FIG. 6, the stepping construction vehicle is positioned on a steep slope with the wheels 9 located at different elevational levels, since the supporting legs 5 can be adjusted in any direction and independently of one another. This construction vehicle can be moved with or without the aid of the boom 3, because its wheels 10 are driven. It is advantageous if the diameter of the driven wheels 10 is larger than that of the steerable wheels 9. With such an arrangement it is possible for the vehicle to drive over considerable obstacles under its own power, even if such obstacles are larger than half the diameter of the driven wheel, because the driven wheel is pressed against the obstacle by means of the boom and then rolls over the obstacle by virtue of the driving means.

A stepping construction vehicle of the type embodying the present invention can be moved, without difficulty, even over marshy terrain wherein, under such travel conditions, the boom as well as the drive for the wheels can be used for effecting forward movement. While in use, the vehicle rests on the wheels 9 and 10. For transportation of the vehicle for long distances over the road, the wheels 20 can be used with the vehicle being loaded onto these wheels by swivelling the supporting legs in the upward direction.

Figure 8:
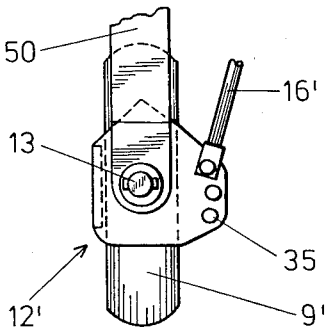
FIGS. 8 and 9 show a plan view and an elevational view, respectively, of one of the steerable wheels on the embodiment illustrated in FIG. 7.
Figure 9:
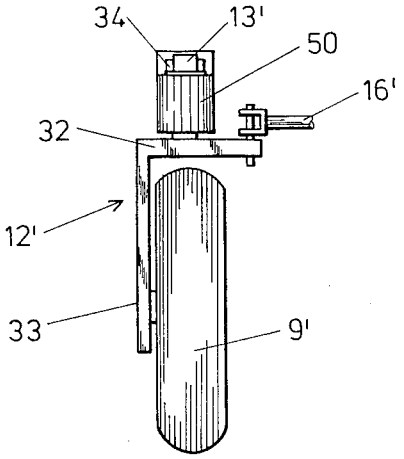
Figure 7:
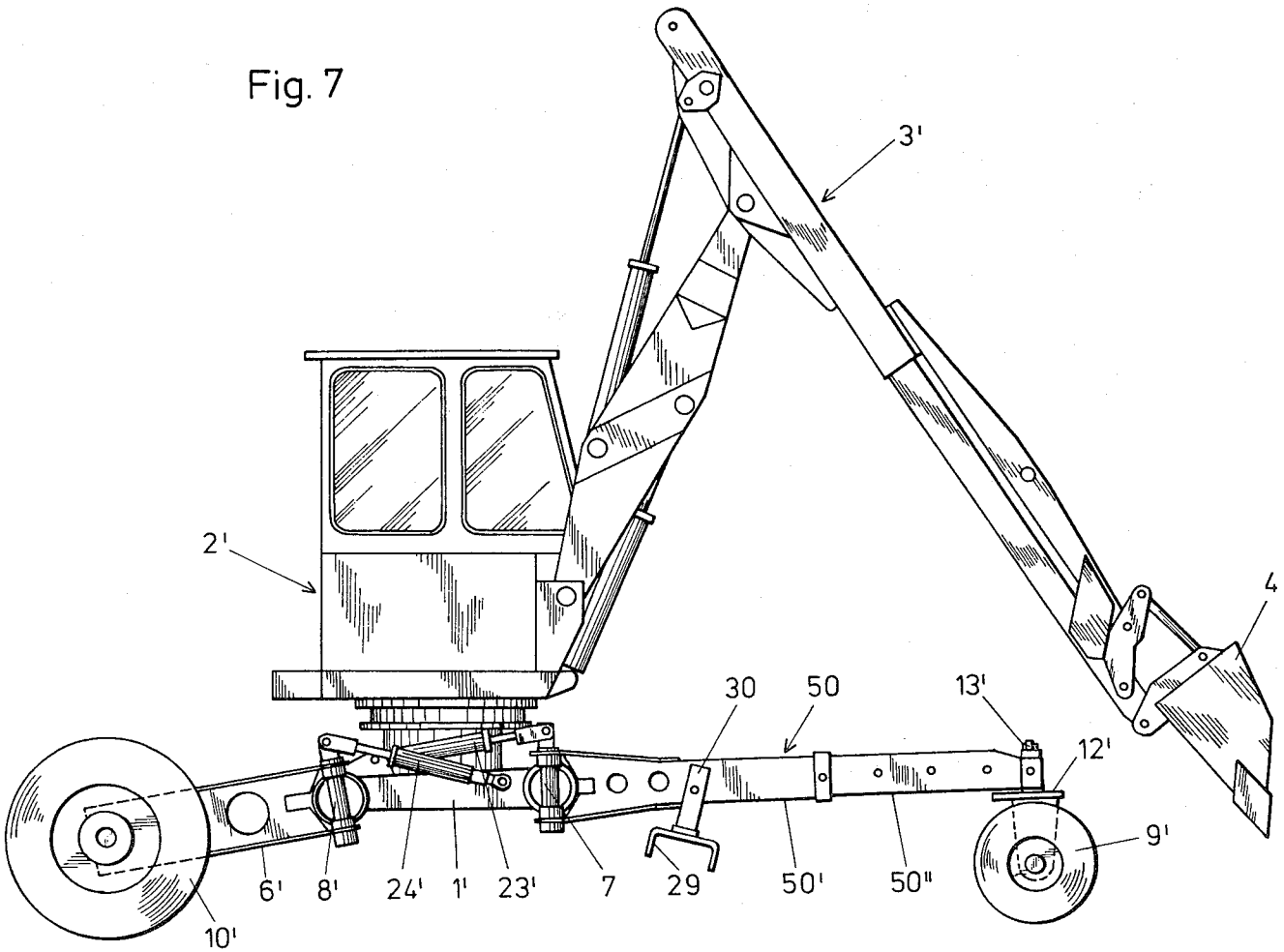
FIG. 7 is an elevational view, similar to FIG. 1, exhibiting a second embodiment of a stepping construction vehicle incorporating the present invention.

In FIG. 7 another embodiment of the stepping excavator-hoist construction vehicle is shown. Basically, the same reference numerals are used identifying the same parts, however, an additional indicia has been added for purposes of differentiation. The construction vehicle displayed in FIG. 7 is essentially the same as the previously described vehicle. There is the difference, however, in the construction of the wheel support 12' for the steerable wheels 9' and also in the provision on the supporting legs 50 which carry the steerable wheels 9, of a sleeve 30 having an upright axis welded close to the horizontal swivel axis. In FIG. 7, it can be seen that the sleeve 30 is located on the tubular section 50' closer to the undercarriage 1'. The supporting journal 31 of the holding claw 29, note FIG. 10, can be inserted from the bottom into the upwardly extending sleeve 30. During operation, the vehicle can be lowered onto this claw, if it is necessary. As can be seen in FIGS. 8 and 9, wheel support 12' is a right-angle member having a horizontal leg 32 and a vertical leg 33. Horizontal leg 32 supports shaft 13' which projects upwardly through and beyond a receiving bore or sleeve in the end of the support leg 50. A cross pin 34 secures the shaft 13' against axial movement within the supporting leg 50. To remove the steerable wheel 9', cross pin 34 is withdrawn and a holding claw 29, note FIG. 10, can be inserted into the receiving bore in the supporting leg. A portion of the horizontal leg 32 projects laterally from the wheel 9' and contains a series of bores 35 into which piston rod 16' of a piston-cylinder assembly can be engaged. As compared to the previously described embodiment, this wheel support 12' has the advantage that the wheel can be turned about a large angle so that a very narrow turning radius can be negotiated.

Therefore, the present invention combines the advantages of a mobile construction vehicle with those of a stepping construction vehicle and affords new and surprising operational possibilities.

While specific embodiments of the invention have been shown and described in detail to illustrate the application of the inventive principles, it will be understood that the invention may be embodied otherwise without departing from such principles.

What is claimed is:

1. An excavator-hoist construction vehicle comprising an undercarriage arranged generally horizontally, said undercarriage having a front edge and an oppositely directed rear edge with side edges extending between said front and rear edges, a superstructure mounted on said undercarriage and rotatable relative thereto about a vertical axis, an elongated boom having a first end and a second end with the first end thereof secured to said superstructure and the second end thereof spaced outwardly from said superstructure, the second end of said boom arranged to support a tool such as for use in excavating, hoisting and the like, a pair of first supporting legs each having a first end and a second end with the first end of each leg being hinged to said front edge of said undercarriage with said hinged connections being spaced apart, and the second ends of said first supporting legs spaced outwardly from said undercarriage, a pair of second support legs each having a first end and a second end with the first end of each being hinged to the rear edge of said undercarriage with the hinged connections being spaced apart and the second ends thereof being spaced outwardly from said undercarriage, said first and second supporting legs being movably adjustable in vertical and horizontal planes, means on the second ends of each of said first and second supporting legs for supporting a wheel, means for steering wheels on at least one pair of said first and second supporting legs, and said steerable wheels being detachably mounted on said supporting legs and being replaceable by holding members depending on the type of work to be performed by the construction vehicle, and means for driving at least one of the wheels on said first and second supporting legs.

2. An excavator-hoist construction vehicle, as set forth in claim 1, wherein steerable wheels being mounted on the second ends of said first supporting legs, and a hydraulic-piston cylinder assembly being attached to each of said first supporting legs for effecting the steering of said steerable wheels mounted thereon.

3. An excavator-hoist construction vehicle, as set forth in claim 2, wherein a wheel support being secured to the second end of each of said first supporting leg for supporting said steerable wheels, said piston-cylinder assembly being secured at one end to said wheel support and the other end thereof to said first supporting leg intermediate the ends thereof.

4. An excavator-hoist cnstruction vehicle, as set forth in claim 3, wherein said first supporting legs comprises a pair of tubular sections one telescopically slidable within the other and including the first tubular section secured to said undercarriage and the second tubular section extendable outwardly from said first tubular section, said steerable wheels being mounted on said second tubular sections and said piston-cylinder assembly attached at one end to said first tubular section at a location adjacent the end thereof spaced outwardly from said undercarriage and detachably securable at the other end thereof to the wheel support which is attached to the end of said second tubular section spaced outwardly from said first tubular section.

5. An excavator-hoist construction vehicle, as set forth in claim 3, wherein said piston-cylinder assembly being removably detachable on said wheel support, a flange secured to the front edge of said undercarriage, and the ends of said piston-cylinder assembly removably detachable to said wheel support being engageable with said flange with the opposite end of said piston-cylinder assembly remaining in engagement with said first supporting leg.

6. An excavator-hoist construction vehicle, as set forth in claim 3, wherein said wheel support including an upwardly extending shaft, each said first supporting leg having a sleeve-like part extending upwardly therethrough with said sleeve-like part having a length less than the axial length of said shaft on said wheel support, and said shaft on said wheel support being positionable within said sleeve-like part upwardly therethrough so that the upper end of said shaft projects upwardly from said supporting leg, and a locking element for securing said shaft in said sleeve-like part against axial movement, said upwardly extending shaft being detachably secured in said sleeve-like part so that said wheel support and said steerable wheel can be removed and replaced by a holding member.

7. An excavator-hoist construction vehicle, as set forth in claim 6, wherein said wheel support comprises an angled member having a horizontal side and a vertical side extending downwardly from said horizontal side, said shaft being secured to and extending upwardly from said horizontal side, and said steerable wheel being mounted on said wheel support below said horizontal side.

8. An excavator-hoist construction vehicle, as set forth in claim 7, wherein said horizontal side of said wheel support having a number of spaced attachment openings therethrough for receiving one end of said piston-cylinder assembly.

9. An excavator-hoist construction vehicle, as set forth in claim 1, wherein means mounted on each of said first supporting legs adjacent the end thereof hinged to said undercarriage for supporting a wheel and said means including a hub connected to said first supporting leg and arranged to receive a wheel for affording support for the vehicle.

10. An excavator-hoist construction vehicle, as set forth in claim 1, wherein means mounted on each of said first supporting legs adjacent the end thereof hinged to said undercarriage for receiving a support member, said means including a generally upright sleeve, and said means including a supporting journal insertable into said sleeve from the bottom thereof, and said support member comprises a claw secured to the lower end of said supporting journal.

11. An excavator-hoist construction vehicle, as set forth in claim 1, wherein a wheel being secured to each of said second supporting arms so that the wheel is not steered, a hub for supporting said wheel on said second supporting leg, and drive means located in said hub for driving said wheel.

12. An excavator-hoist construction vehicle, as set forth in claim 11, wherein each of said hubs on said second supporting legs being pivotally mounted about upright axes, and a parallel steering suspension attached to said second supporting legs and to the rear side of said undercarriage for maintaining said second supporting legs in parallel relation.

13. An excavator-hoist construction vehicle, as set forth in claim 1, wherein steerable wheels being mounted on said first supporting legs, driven wheels being mounted on said second supporting legs, and the diameter of said driven wheels being larger than the diameter of said steerable wheels.

* * * * *